US007160260B2

(12) United States Patent
Hsiao

(10) Patent No.: US 7,160,260 B2
(45) Date of Patent: Jan. 9, 2007

(54) MASSAGE BED

(76) Inventor: Yun Chien Hsiao, No. 276, Sec. 2, Hai-Tien Rd., Tainan (TW)

( * ) Notice: Subject to any disclaimer, the term of this patent is extended or adjusted under 35 U.S.C. 154(b) by 645 days.

(21) Appl. No.: 10/671,443

(22) Filed: Sep. 29, 2003

(65) Prior Publication Data

US 2005/0070826 A1 Mar. 31, 2005

(51) Int. Cl.
*A61H 1/00* (2006.01)

(52) U.S. Cl. ..... 601/49; 601/57

(58) Field of Classification Search ..... 601/46, 601/49, 50, 51, 56–57, 70, 136
See application file for complete search history.

(56) References Cited

U.S. PATENT DOCUMENTS 3,512,834 A * 5/1970 Lockshin ..... 297/440.11
5,642,539 A * 7/1997 Kuo ..... 5/423
6,554,353 B1 * 4/2003 Yu ..... 297/130
6,669,291 B1 * 12/2003 Hsiao ..... 297/284.3

* cited by examiner

*Primary Examiner*—Michael A. Brown
(74) *Attorney, Agent, or Firm*—Bacon & Thomas, PLLC

(57) ABSTRACT

A massage bed includes a frame with four sides. The frame has multiple seats mounted at the four sides. Multiple elastic straps are mounted by the seats and interleavedly extend between the opposite sides in longitudinal and transversal directions. Multiple massage members are individually mounted on the transversal elastic straps. Multiple clamping members are respectively mounted cross points of the longitudinal and transversal elastic straps. A cover with good elasticity and air permeability is spread over the frame. Whereby, the massage bed has a good air permeability and is easy to maintain.

14 Claims, 4 Drawing Sheets

MASSAGE BED

BACKGROUND OF THE INVENTION

1. Field of the Invention

The present invention relates to a massage apparatus, and more particularly to a massage bed.

2. Description of Related Art

A conventional massage bed generally has several sets of rollers parallel to each other. Each set has multiple rollers with various appearances and clearances for massaging a neck, back, waist, buttocks, thighs and calves. However, the conventional massage bed has a very complex structure and a high price. In a situation that one roller becomes damaged, the whole set of rollers integrated together must be removed for maintenance. Moreover, the conventional massage bed is generally covered with leather which has a low air permeability, so a user lying on the bed will feel discomfort. A further drawback is that the configuration of the rollers is unchangeable and so cannot meet different requirements of users.

Therefore, the invention provides a massage bed to mitigate or obviate the aforementioned problems.

SUMMARY OF THE INVENTION

The main objective of the present invention is to provide a massage bed which has a good air permeability and of which massage members can be individually replaced for maintenance.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
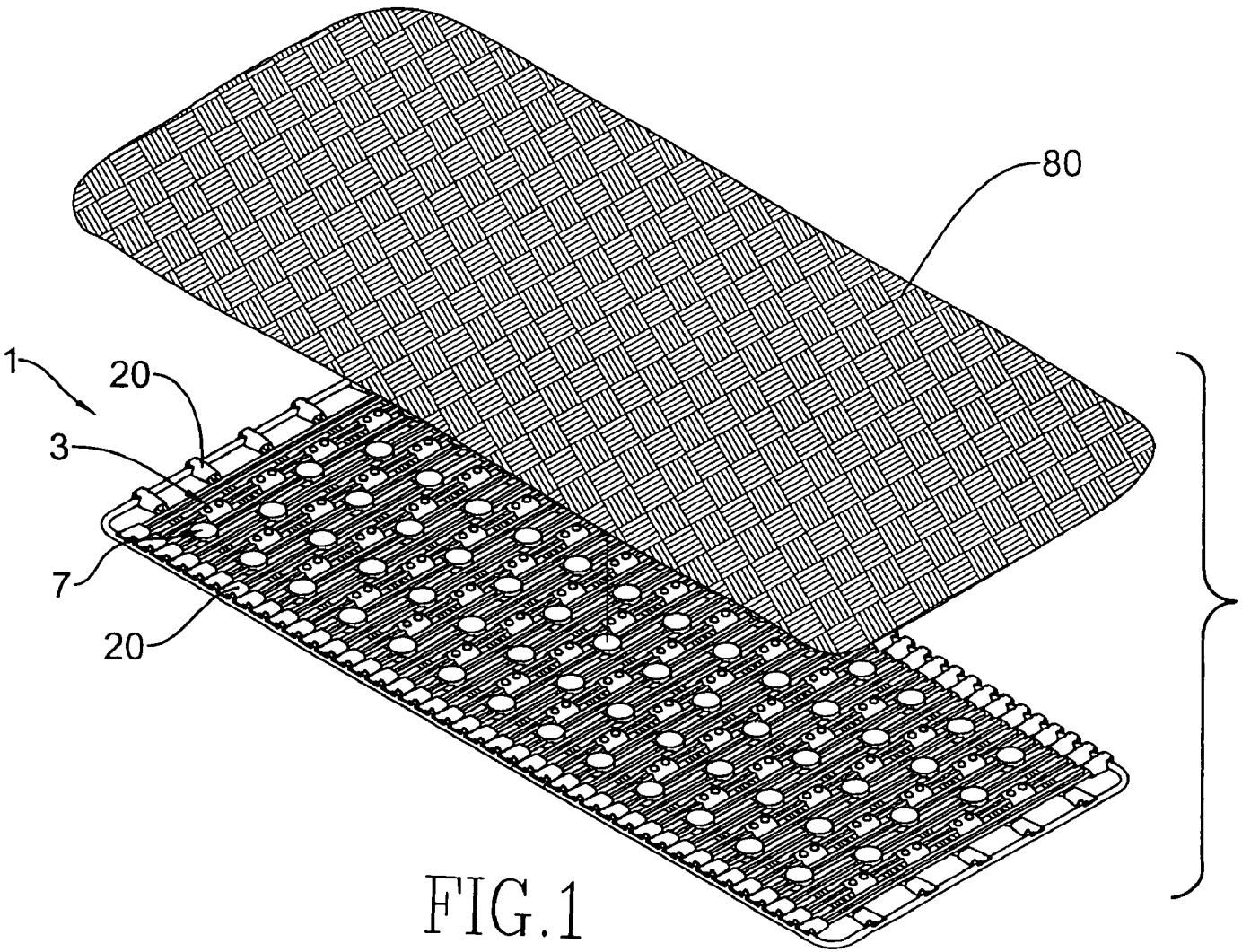
FIG. 1 is an exploded perspective view of a massage bed in accordance with the present invention.
Figure 2:
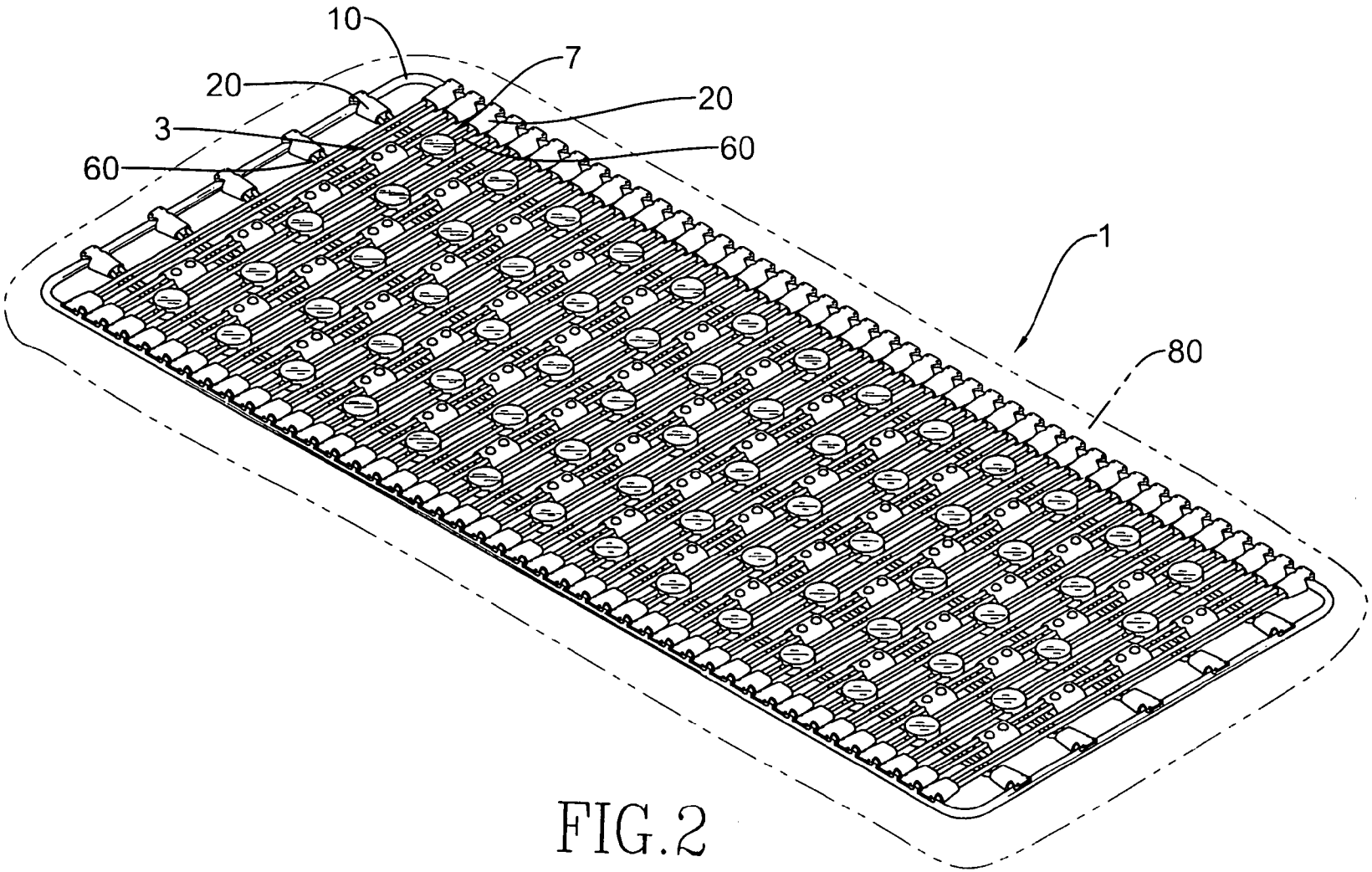
FIG. 2 is a perspective view of a frame of the massage bed in FIG. 1.

With reference to FIGS. 1 and 2, a massage bed (1) in accordance with the present invention has a frame (10) with four sides. Multiple seats (20) are mounted at the four sides of the frame (10) and multiple elastic straps (60) are mounted by the seats (20) and interleavedly extend between the opposite sides of the frame (10) in longitudinal and transversal directions.

Multiple massage members (3) are individually mounted on the transversal elastic straps (60), and multiple clamping members (7) are respectively mounted at cross points of the longitudinal and transversal elastic straps (60). The frame (10) is covered with a cover (80) with good elasticity and air permeability.

Figure 3:
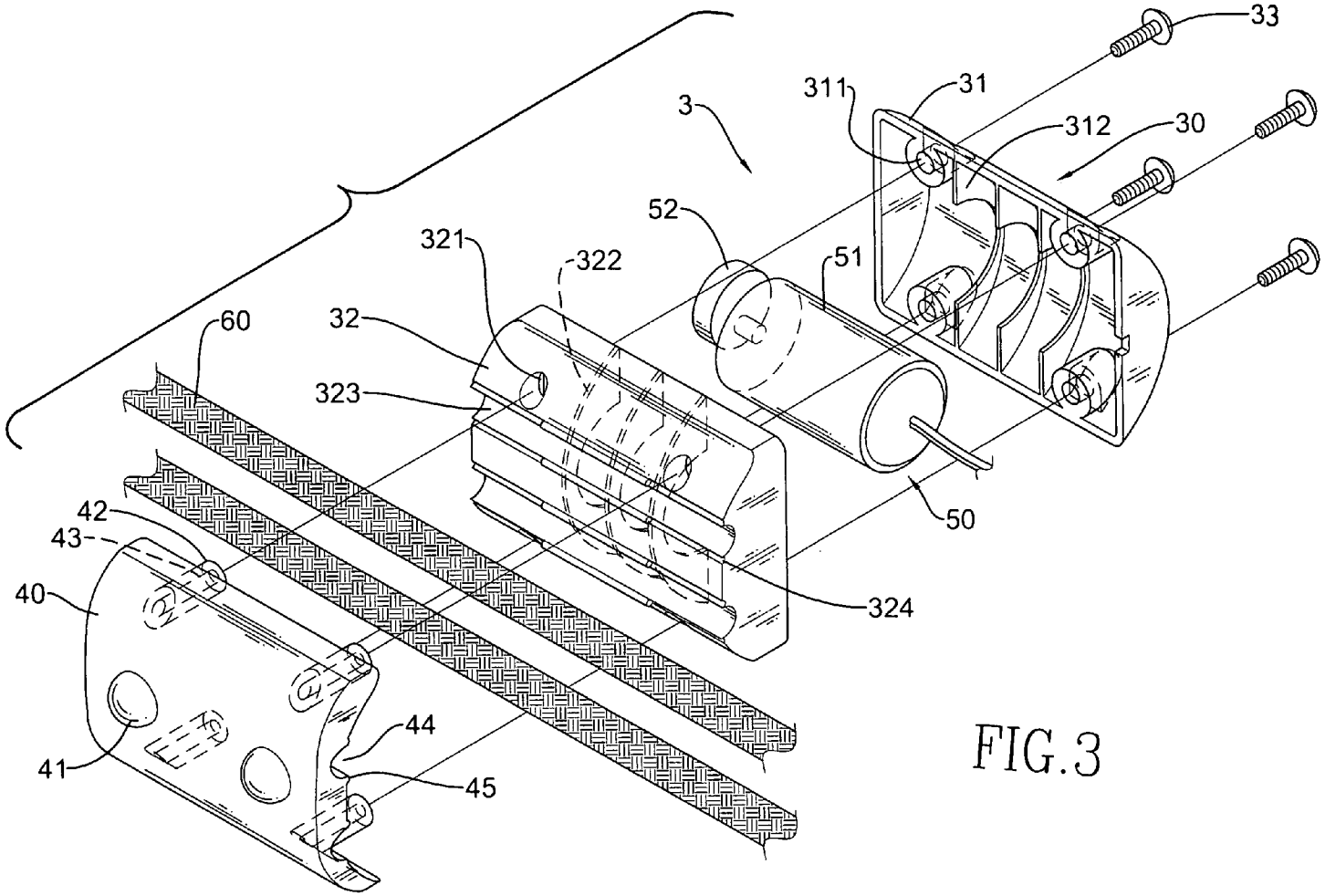
FIG. 3 is an exploded perspective view of a massaging member on the massage bed.

With reference to FIG. 3, the massage member (3) is composed of a housing (30), a panel (40) and a vibrator (50).

The housing (30) is composed of a first semi-housing (31) and a second semi-housing (32) combined with the first semi-housing (31) by screws (33). The panel (40) is mounted outside the second semi-housing (32) by the screws (33). Two first slots (323) are transversally defined at an exterior surface of the second semi-housing (32) facing the panel (40), and two second slots (44) are transversally defined at an interior surface of the panel (40) facing the second semi-housing (32) and aligned with the first slots (323). The transversal elastic straps (60) are respectively clamped between the matched first slots (323) and the second slots (44), so the massage members (3) can be directly mounted on the transversal straps (60).

The vibrator (50) is received in the housing (30) and is composed of a motor (51) and a cam (52) eccentrically mounted at an end of the motor (51). When the cam (52) is driven by the motor (51) to rotate, the housing (30) vibrates. The housing (30) further has multiple first ribs (312) formed on an inner wall of the first semi-housing (31), and multiple second ribs (322) formed on an inner wall of the second semi-housing (32). The motor (51) of the vibrator (50) is securely positioned between the first and second ribs (312, 322).

The first semi-housing (31) has multiple first holes (311) defined therethrough, the second semi-housing (32) has multiple second holes (321) defined therethrough and aligned with the first holes (311). The panel (40) has multiple poles (42) protruded from the interior surface and respectively inserted in the second holes (321). The poles (42) each have a first threaded hole (43) defined therein and the screws (33) are respectively inserted through the first holes (311) and engaged in the threaded holes (43) of the poles (42), so the panel (40) is secured on the second semi-housing (32).

The panel (40) further has multiple protrusions (41) protruded from an exterior surface for pressing a user's body. The protrusions (41) and the panel (40) can be integrally made of plastic material, or the panel (40) can be made of rigid plastic and the protrusions (41) made of elastic PU material.

Two grooves (324) are transversally defined at two sides of each of the first slots (323), and two ridges (45) are transversally formed at two sides of each of the second slots (44) and matching the corresponding grooves (324), so the transversal straps (60) are further securely fastened. Alternatively, the grooves can be defined beside the second slots (44), and the ridges can be formed beside the first slots (324), which has the same effect as the vice-versa.

Figure 4:
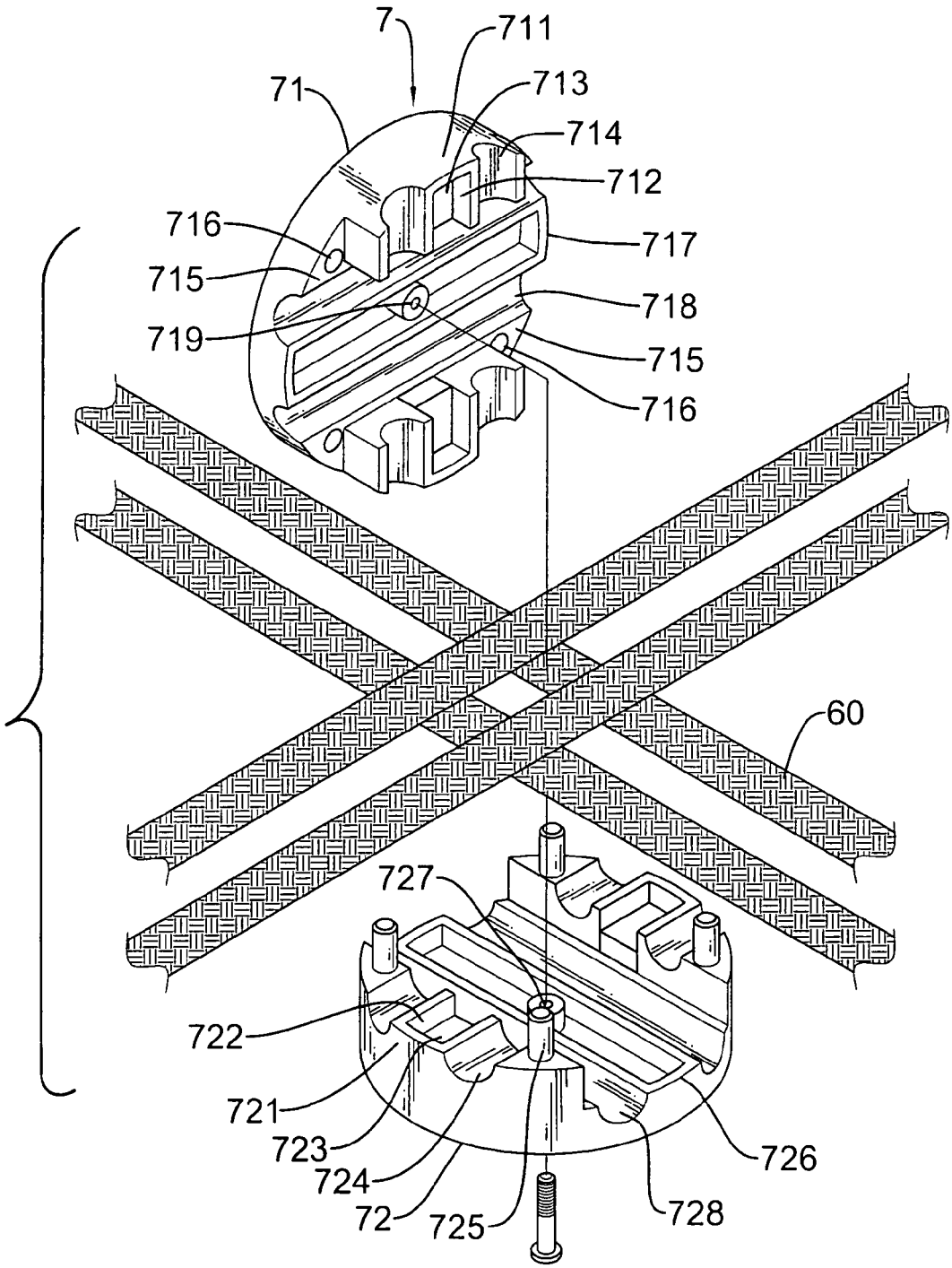
FIG. 4 is an exploded perspective view of a clamping member on the massage bed.

With reference to FIG. 4, the clamping member (7) is composed of an upper disk (71) and a lower disk (72). The upper disk (71) has two longitudinal ears (711) formed at two diametrically opposite sides thereof, and a transversal channel (717) defined between the two longitudinal ears (711). The lower disk (72) has two transversal ears (721) formed at two diametrically opposite sides thereof and a longitudinal channel (726) defined between the two transversal ears (721). When the upper disk (71) is assembled with the lower disk (72), the longitudinal ears (711) of the upper disk (71) are positioned in the longitudinal channel (726) of the lower disk (72), and the transversal ears (721) of the lower disk (72) are positioned in the transversal channel (717).

The upper disk (71) has two pairs of third slots (714) longitudinally defined through the longitudinal ears (711), and the lower disk (72) has two fourth slots (728) defined in the longitudinal channel (726) and aligned with the two pairs of third slots (714). The longitudinal straps (60) are respectively positioned in the matched third and fourth slots (714, 728). A pair of longitudinal pits (712) is defined between the third slots (714) and two first magnets (713) are respectively mounted in the longitudinal pits (712).

The lower disk (72) has two pairs of fifth slots (724) transversally defined through the transversal ears (721), and the upper disk (71) has two sixth slots (718) transversally defined in the transversal channel (717) and aligned with the fifth slots (724). The transversal straps (60) are respectively positioned in the matched fifth and sixth slots (718, 724). A pair of transversal pits (722) is defined between the fifth slots (724) and two second magnets (723) are respectively mounted in the transversal pits (722).

The straps (60) are loosely clamped between the upper and lower disks (71, 72) and still can stretch in the clamping members (7).

The upper disk (71) has a second threaded hole (719) defined at the center thereof, and the lower disk (72) has a third hole (727) aligned with the threaded hole (719). A screw (not numbered) is inserted through the third hole (727) and engaged in the second threaded hole (719) to fasten the lower disk (72) to the upper disk (71).

The upper disk (71) has four apertures (716) respectively defined at four first sectors (715) between the longitudinal ears (711) and the transversal channel (717). The lower disk (72) has four pins (725) respectively at four second sectors (not numbered) outside the transversal ears (721) and inserted in the apertures (716).

Therefore, according to the invention, the massage members are individually mounted on the frame by the elastic straps, so it is very convenient to maintain the damaged massage members. Furthermore, the frame is covered with the cover with good air permeability, so a user cannot feel discomfort even if lying on the massage bed for a long time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A massage bed comprising:

a frame with two first opposed sides and two second opposed sides perpendicular to the first sides, the frame having multiple seats mounted at the first and second sides, and multiple elastic straps mounted by the seats and interleavedly extending between the opposed sides in longitudinal and transversal directions;

multiple massage members individually mounted on the transversal elastic straps;

multiple clamping members respectively mounted at cross points of the longitudinal and transversal elastic straps; and a cover with good elasticity and air permeability spread over the frame.

2. The massage bed as claimed in claim 1 wherein the massage member comprises a housing being composed of a first semi-housing and a second semi-housing assembled together by screws, the second semi-housing having multiple first transversal slots defined at an exterior surface of the second semi-housing;

a panel mounted on the exterior surface of the second semi-housing, the panel having multiple second transversal slots defined at an interior surface facing the exterior surface of the second semi-housing and aligned with the first transversal slots, the transversal elastic straps respectively clamped between the matched first slots and the second slots;

and a vibrator mounted in the housing.

3. The massage bed as claimed in claim 2 wherein the vibrator comprises a motor and a cam eccentrically mounted at an end of the motor.

4. The massage bed as claimed in claim 3 wherein the first semi-housing has multiple first ribs formed on an inner wall thereof, the second semi-housing has multiple second ribs formed on an inner wall thereof, and the motor is securely positioned between the first and second ribs.

5. The massage bed as claimed in claim 2 wherein the first semi-housing has multiple first holes defined therethrough, the second semi-housing has multiple second holes defined therethrough and respectively aligned with the first holes, the panel has multiple poles each with a threaded hole and protruded from the interior surface thereof and respectively inserted in the second holes, and the screws are respectively inserted through the first holes and engaged in the threaded holes of the poles to secure the panel on the second semi-housing.

6. The massage bed as claimed in claim 5 wherein the panel has multiple protrusions protruded from an exterior surface thereof for pressing against a user's body.

7. The massage bed as claimed in claim 6 wherein the protrusions and the panel are integrally made of plastic material,

8. The massage bed as claimed in claim 6 wherein the panel is made of rigid plastic, and the protrusions are made of elastic PU material.

9. The massage bed as claimed in claim 2 wherein the second semi-housing has at least one groove transversally defined at a side of each of the first slots, and the panel has at least one ridge transversally formed at a side of each of the second slots and matching the corresponding groove.

10. The massage bed as claimed in claim 1 wherein the clamping member is composed of an upper disk and a lower disk, wherein the upper disk has two longitudinal ears formed at two diametrically opposite sides thereof, and a transversal channel defined between the two longitudinal ears, and the lower disk has two transversal ears formed at two diametrically opposite sides thereof and a longitudinal channel defined between the two transversal ears, the longitudinal ears of the upper disk positioned in the longitudinal channel of the lower disk, and the transversal ears of the lower disk positioned in the transversal channel.

11. The massage bed as claimed in claim 10 wherein the upper disk has two pairs of third slots longitudinally defined through the longitudinal ears, and the lower disk has two fourth slots defined in the longitudinal channel and aligned with the two pairs of third slots to respectively position the longitudinal straps in the matched third and fourth slots; and the lower disk has two pairs of fifth slots transversally defined through the transversal ears, and the upper disk has two sixth slots transversally defined in the transversal channel and aligned with the fifth slots to respectively position the transversal straps in the matched fifth and sixth slots.

12. The massage bed as claimed in claim 11 wherein the upper disk has a pair of longitudinal pits defined between the third slots, and two first magnets are respectively mounted in the longitudinal pits; and the lower disk has a pair of transversal pits defined between the fifth slots, and two second magnets respectively mounted in the transversal pits.

13. The massage bed as claimed in claim 11 wherein the upper disk has a second threaded hole defined at the center thereof, the lower disk has a third hole aligned with the second threaded hole, and a screw is inserted through the third hole and engaged in the second threaded hole to fasten the lower disk to the upper disk.

14. The massage bed as claimed in claim 13 wherein the upper disk has four apertures respectively defined at four first sectors formed by the longitudinal ears and the transversal channel, and the lower disk has four pins respectively formed at four second sectors formed by the transversal ears and the longitudinal channel and inserted in the apertures.

* * * * *